US007243426B2

(12) United States Patent
Schreiber et al.

(10) Patent No.: US 7,243,426 B2
(45) Date of Patent: Jul. 17, 2007

(54) METHOD FOR THE MANUFACTURE OF A COMBUSTION CHAMBER OF A GAS-TURBINE ENGINE

(75) Inventors: Karl Schreiber, Mellensee (DE); Heike Floege, Zossen (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 0 days.

(21) Appl. No.: 09/731,250

(22) Filed: Dec. 7, 2000

(65) Prior Publication Data

US 2001/0003226 A1 Jun. 14, 2001

(30) Foreign Application Priority Data

Dec. 9, 1999 (DE) ..... 199 59 292

(51) Int. Cl.
*B21K 3/00* (2006.01)

(52) U.S. Cl. ..... 29/888.01

(58) Field of Classification Search ..... 60/732, 60/722, 760, 752; 219/121.64; 29/888.01, 29/890.039, 890.054, 525.14, 527.5
See application file for complete search history.

(56) References Cited

U.S. PATENT DOCUMENTS

| | | | | |
|---|---|---|---|---|
| 4,296,606 | A | | 10/1981 | Reider |
| 4,708,750 | A | | 11/1987 | Field et al. |
| 4,833,295 | A | * | 5/1989 | Locker et al. |
| 5,018,661 | A | * | 5/1991 | Cyb |
| 5,181,379 | A | | 1/1993 | Wakeman et al. |
| 5,430,346 | A | * | 7/1995 | Johnson ..... 313/139 |
| 5,958,332 | A | * | 9/1999 | Hoeg |
| 5,968,672 | A | * | 10/1999 | Mitsuyoshi et al. |
| 5,975,407 | A | * | 11/1999 | Gasse et al. ..... 228/121 |
| 6,016,785 | A | * | 1/2000 | Divecha et al. |

FOREIGN PATENT DOCUMENTS

| | | |
|---|---|---|
| DE | 69123707 | 7/1997 |
| DE | 69501555 | 8/1998 |
| DE | 29913964 | 12/1999 |
| EP | 0753704 | 1/1997 |
| EP | 0892218 | 1/1999 |
| WO | WO95/29785 | 11/1995 |
| WO | WO99/06771 | 2/1999 |

OTHER PUBLICATIONS

Patent Abstracts of Japan, vol. 1995, No. 04, May 31, 1995 and JP 07027335 (Hitachi Ltd) Jan. 27, 1995.
Elektronenstrahl-Schweissen zum Instandsetzen von Triebwerken. In: Werkstatt und Betrieb 127, 1994, 4, S. 228-229.
Arn, H.P.: Schweissverfahren im Triebwerksunter-halt. In: Technika, May 1989, S. 75-80.

* cited by examiner

*Primary Examiner*—T. Nguyen
(74) *Attorney, Agent, or Firm*—Timothy J. Klima

(57) ABSTRACT

This invention relates to a method for the manufacture of a gas-turbine combustion chamber which consists of individual wall sections produced by casting. To make up the combustion chamber, the wall sections are joined by laser welding. Preferably, the individual wall sections are segments of the annular or circular combustion chamber, with the casting material of the wall sections being a high-temperature nickel-base casting alloy.

16 Claims, No Drawings

METHOD FOR THE MANUFACTURE OF A COMBUSTION CHAMBER OF A GAS-TURBINE ENGINE

BACKGROUND OF THE INVENTION

This invention relates to a method for the manufacture of a combustion chamber of a gas-turbine engine, this combustion chamber consisting of individual wall sections made by a casting process. For background art, reference is made to EP 0 753 704 A1, by way of example.

Gas-turbine combustion chambers are normally made of forged and/or rolled rings which are subsequently machined and suitably drilled. For increased thermal strength, thermal barrier coatings are partly applied to the rings. The dome of the combustion chamber, which is subject to extremely high thermal stress, is in some designs made as a casting in a highly temperature-resistant nickel-base casting alloy. The rings and the dome of the combustion chamber are usually joined by welding, however, the thermal strength of this weld joint is inferior to that of the casting, this circumstance being due to the limited thermal strength of the weld filler material.

The manufacturing route, i.e. the forging and subsequent machining of the ring and, if applicable, the subsequent welding of the cast dome, incurs an enormous manufacturing effort. Furthermore, the forging materials available are inferior to the precision casting materials available in terms of their thermo-mechanical strength above 1000° C., as a result of which a considerable share of the air compressed in the compressor of the gas-turbine engine is to be used for the cooling of components and is thus not available for combustion. This impairs the power density, the specific fuel consumption and the pollutant-emission characteristics of the gas-turbine engine.

The above-mentioned EP 0 753 704 A1 teaches a gas turbine whose combustion chamber and a subsequent transition piece to the downstream turbine section are each made as cylindrical castings without weld, with the combustion chamber and the transition piece being joined together by inert-gas welding. Full castability, i.e. castability in one piece, as proposed in the referenced Specification, is, however, limited to small combustion chambers for gas-turbine engines in the lower thrust range. In the thrust range above 10,000 lbs. take-off thrust, the manufacture of a combustion chamber by casting is not economical due to constraints such as the size of the combustion chamber and the dimensional and quality requirements.

BRIEF SUMMARY OF THE INVENTION

In a broad aspect, the present invention provides a method enabling larger combustion chambers of gas-turbine engines to be completely manufactured of a casting material, i.e. from wall sections made by a casting process. It is a particular object of the present invention to provide remedy to the above problematics by providing wall sections which are joined together by laser welding to make up the combustion chamber. Further advantageous objects of the present invention are cited in the subclaims.

DETAILED DESCRIPTION OF THE INVENTION

According to the present invention, the individual cast wall sections of a gas-turbine combustion chamber are to be joined by laser welding. In particular if the casting material is a highly temperature-resistant nickel-base casting alloy, the low energy input of the laser welding process will enable a crack-free joint to be made between the wall sections in the nickel-base casting materials, with the weld filler metal with inferior thermal strength being dispensable. Weldability free from cracking was demonstrated on the high-strength casting alloy C1023, for example.

Accordingly, the individual wall sections of the combustion chamber can preferably be made by the precision casting process and joined, i.e. combined, by laser welding after machining, if necessary, of the joining edges, with the laser weld being also producible with the now very cost-effective diode lasers. Preferably, the individual wall sections are segments of the annular or circular combustion chamber, i.e. when viewing the combustion chamber in a cross-section vertical to the longitudinal axis of the combustion chamber, the wall sections following each other form a circle or annulus, with the sections being segments of this circle or annulus and extending in the direction of the combustion chamber longitudinal axis, preferably throughout its length. Since an annular combustion chamber is known to comprise several burners, one wall section or segment, respectively, may be allocated to one burner in the combustion chamber manufactured to the method according to the present invention.

The method proposed by this Specification provides for reduced manufacturing costs and increased thermo-mechanical strength of the combustion chamber and, as consequence thereof, for an increased specific power density, a reduced specific fuel consumption and a reduced pollutant emission of the gas-turbine engine.

The invention claimed is:

1. A method for manufacturing a combustion chamber of a gas-turbine engine comprising:

casting a plurality of individual dome and ring wall sections of a combustion chamber of gas-turbine engine, wherein the individual dome and ring wall sections are from a same highly-temperature resistant nickel-based casting alloy;

joining the individual cast dome and ring wall sections by laser welding to make up the combustion chamber;

wherein the welded joints have a thermo-mechanical strength substantially the same as the individual cast dome and ring wall sections.

2. The method of claim 1, wherein the individual dome and ring cast wall sections are annular/circular segments of the combustion chamber.

3. The method of claim 2, wherein the laser welding is performed without filler material.

4. The method of claim 3, wherein the laser welding inputs low energy to the wall sections.

5. The method of claim 4, wherein the laser welding is performed with a diode laser.

6. The method of claim 5, wherein the laser welding provides a crack-free joint between cast wall sections.

7. The method of claim 6, wherein the highly-temperature resistant nickel-based casting alloy is C1023.

8. The method of claim 1, wherein the laser welding is performed without filler material.

9. The method of claim 1, wherein the laser welding inputs low energy to the wall sections.

10. The method of claim 1,
wherein the laser welding is performed with a diode laser.

11. The method of claim 1,
wherein the laser welding provides a crack-free joint between cast wall sections.

12. The method of claim 1,
wherein the highly-temperature resistant nickel-based casting alloy is C1023.

13. The method of claim 2,
wherein the highly-temperature resistant nickel-based casting alloy is C1023.

14. The method of claim 13,
wherein the laser welding is performed without filler material.

15. The method of claim 2, wherein a dome portion and a ring portion of each individual wall section are cast together.

16. The method of claim 2, wherein a dome portion and a ring portion of each individual wall section are welded together.

* * * * *